United States Patent [19]

Arcand

[11] 4,315,463

[45] Feb. 16, 1982

[54] BLASTING MAT

[76] Inventor: Leo H. Arcand, R.R. #1, Sturgeon Falls, Ontario, Canada, P0H 2G0

[21] Appl. No.: 118,851

[22] Filed: Feb. 5, 1980

[51] Int. Cl.[3] ..... F42D 5/00

[52] U.S. Cl. ..... 102/303; 89/36 A

[58] Field of Search ..... 102/22 BM, 303; 89/36 A

[56] References Cited

U.S. PATENT DOCUMENTS

| | | | |
|---|---|---|---|
| 2,926,605 | 3/1960 | Hammel, Jr. et al. . | |
| 3,331,322 | 7/1967 | Belanger | 102/22 BM |
| 3,371,604 | 3/1968 | Wikner et al. . | |

FOREIGN PATENT DOCUMENTS

| | | | |
|---|---|---|---|
| 753870 | 3/1967 | Canada | 102/22 BM |
| 1019201 | 10/1977 | Canada | 102/22 BM |
| 1019202 | 10/1977 | Canada | 102/22 BM |
| 124433 | 3/1949 | Sweden | 102/22 BM |
| 150784 | 7/1955 | Sweden | 102/22 BM |
| 162718 | 4/1958 | Sweden | 102/22 BM |

*Primary Examiner*—Peter A. Nelson

*Attorney, Agent, or Firm*—Cushman, Darby & Cushman

[57] ABSTRACT

A blasting mat is provided with a body of sectional construction comprising an array of vehicle tire elements, which tire elements are mounted and held in place by retaining lines. The tire elements are arranged tread to tread, in rows, which rows are positioned adjacent to similar rows in stacked offset fashion, the rows in this manner alternating and forming a brickwork pattern. Interior lines are threaded through holes in side walls of individual tire elements holding the array in place. Reinforcing bars positioned at the ends of the array prevent the tearing of tire elements in the vicinity of the bars, during a blasting operation. The blasting mat may be pulled from place to place by means of exterior lines which are attached along their length to parts of the above-mentioned interior lines that are adjacent to the ends of the blasting mat.

11 Claims, 8 Drawing Figures

BLASTING MAT

BACKGROUND OF THE INVENTION

This invention relates to blasting mats which are constructed from resilient sections of used tires.

Blasting mats constructed from sections of used vehicle tires are known, an example of such blasting mat being described in Canadian Pat. No. 753,870, granted to Lionel Belanger on Mar. 7, 1967. When excavating to permit construction in rocky areas, blasting is often required to loosen or fragment the substrata, before digging may take place. After explosive material has been planted, it is desirable, before detonation, to provide a means which will muffle or dampen the upward thrust of the exploding material. The provision of such a dampening means causes the forces of the explosion to radiate outwardly and downwardly where they are most useful. Additionally, such a means reduces or eliminates the scattering of debris from the explosion site. Blasting mats have therefore been used to improve the effectiveness of blasting, and to protect workers, machinery, buildings or the like, located at close proximity, from the hazards normally associated with unprotected blasting.

It is desirable that a blasting mat be transportable, and be made up of strong, resilient and inexpensive sections which are easy to assemble. The sections are desirably held together in fixed proximity each to the other by sufficiently strong means so that the mat may withstand the impact forces of repeated explosions.

A major disadvantage with the Belanger blasting mat, illustrated and described in Canadian Pat. No. 753,870, and other known blasting mats, arises due to the nature of the sections used in construction. They are sections of used tire halves. The tire halves normally have been cut into three or more sections which have been provided with holes near the ends of each section so that the sections may be threaded into a mat structure with steel cable or the like. During blasting operations the sections tend to pull away from the cables, and there tends to be tearing in the ends of the sections in a direction tangential to the circumferential arc of the tire section at a point located at the end of the tire section. The Belanger arrangement of tire sections is relatively complex, and the expense of cutting tires into sections is another disadvantage of the Belanger proposal.

While used tires which are suitable for incorporation into a blasting mat may have had external features, such as the tread portions, worn away to some extent, the internal features, such as internal cord structures, normally remain intact. At least some of the internal cords are oriented circumferentially around the axis of rotation of the tire. For the purposes of this specification, a vehicle tire is presumed to have an axis of rotation which is the straight line about which the tire would rotate if it were operationally mounted on a vehicle. If these cords are cut when each tire half is sectioned along lines which extend radially through the tire, as proposed by Belanger and others, then during a blasting operation, the forces on the tire section are such that the cables holding the mat together tend to pull out of the tire sections in a direction parallel or nearly parallel to the internal cords which have been severed. The ability of each individual section to withstand these stresses, and the strength of the mat as a whole, is accordingly diminished by the severing of the internal cords in the tires.

SUMMARY OF THE INVENTION

These disadvantages can be overcome according to the present invention by constructing the blasting mat from whole tires, or from tires that have only been cut in a direction which is parallel to a plane to which the axis of rotation of the tire is normal. Whole tires, or tires that have been cut in this manner are referred to as tire elements, which tire elements may be described as being intact circumferentially.

The strength of blasting mats made according to the present invention is also enhanced because working surfaces of the mat, which are those surfaces which may be adjacent to the ground wherein the blasting is taking place, are primarily made up of the tread portions of tire elements.

Further, for a given tire dimension, blasting mats that are constructed using sections of used tire halves are normally lighter and thinner than are blasting mats which are constructed from tire elements which are intact circumferentially, according to the present invention.

It is thus a primary object of the invention to provide a blasting mat of the type including resilient sections in which the sections are tire members that have their circumferential tire cord structure intact. It is a further object of a preferred embodiment of the invention to provide a blasting mat of relatively easy assembling characteristics.

In its broadest aspect, a blasting mat according to the invention is an interconnected array of circumferentially intact vehicle tire elements, comprising alternating, contacting rows of tread to tread contacting tires of similar peripheral dimensions with the tire elements in any given row offset by about one-half a tire diameter from the adjacent tire elements in each adjacent row, thus forming a brickwork pattern, and retaining means contacting the tire elements and retaining the tire elements in the array.

The tire elements may be similarly perforated generally parallel to their axes of rotation and the retaining means may be lines passing through the perforations. Additionally, every second row may include corresponding end half-sections of tire elements of similar dimension to the circumferentially intact tire elements.

It will be apparent that the purpose of offsetting adjacent rows of tire elements is to strengthen the blasting mat in the direction which is in the plane of the mat and roughly perpendicular to the axis of rotation of any of the tire elements in the array. The resulting overall pattern of tire elements is called a brickwork pattern because the tire elements are positioned in the array in a configuration that is suggestive of the positioning of bricks in a wall constructed therewith.

It will also be apparent that tire elements may be positioned in an array forming a brickwork pattern by providing offsetting adjacent rows, each of which may be made up of subsidiary rows of tire elements which are not offset.

In accordance with another aspect, there is provided according to the invention a blasting mat which has two broad surfaces, two sides and two ends, comprising a rectangular array of vehicle tires having side walls and at least partial tread portions, the majority of which tires are intact circumferentially. The axis of rotation of each tire is parallel to both the broad surfaces of the array and the sides to the array. Retaining means are provided for holding the vehicle tires in fixed relationship and close proximity one to the other. The retaining means may be lines, such as cables, chains, ropes, or the like which are threaded through holes provided in the side walls of the vehicle tires. The rectangular array of tires may be made up of adjacent rows of tires, each row of which may be made up of adjacent tires which have been aligned so that the axis of rotation of each of the tires is perpendicular to the row.

Tire halves, manufactured by halving used vehicle tires in the plane normal to the axis of rotation of the tire may be incorporated into the above-referenced rectangular array, in which case the tire halves may be oriented in a uniform direction. The ends of the blasting mat may be reinforced by rigid bars to which the connecting means may be threaded. The connecting means may hold the rectangular array in a compressed state and there may be provided, points of accessibility to said connecting means along the ends of the blasting mat, which points of accessibility may roughly correspond to points of attachment to pulling means by which the blasting mat may be transported or pulled from place to place. The connecting means may be a network of cables in the nature of two layers of cables which are roughly parallel to and are relatively close to the respective broad surfaces of the blasting mat.

The number of tires, their size and the degree of compression applied to the mat, and the dimensions and overall weight of the blasting mat will be selected to optimize its effectiveness given the type of blasting required.

DETAILED DESCRIPTION OF A PREFERRED EMBODIMENT

Figure 1:
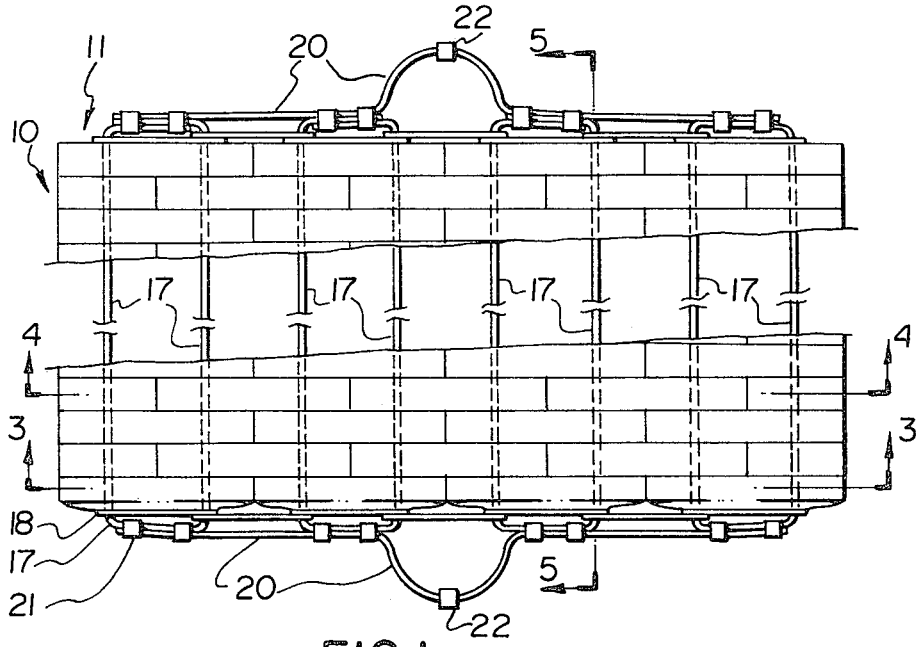
FIG. 1 is a plan view of a preferred embodiment of a blasting mat according to the invention.
Figure 2:
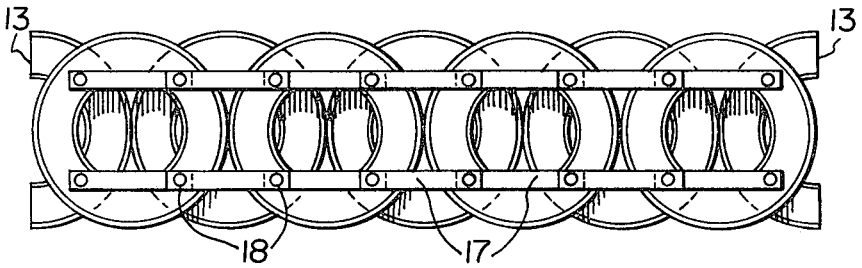
FIG. 2 is an end view of a blasting mat which is shown in plan view in FIG. 1.
Figure 4:
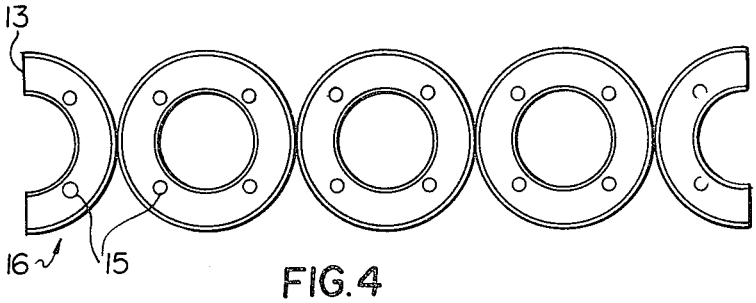
FIG. 4 is an elevation view of a section of the blasting mat taken along line 4—4 of FIG. 1.
Figure 6:
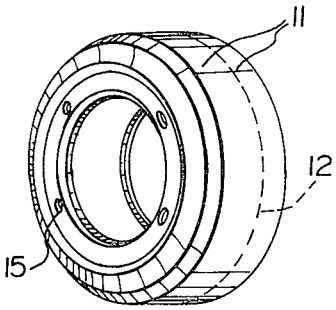
FIG. 6 is a perspective view of a vehicle tire which may be halved and may be used in the rectangular array, according to the invention.
Figure 7:
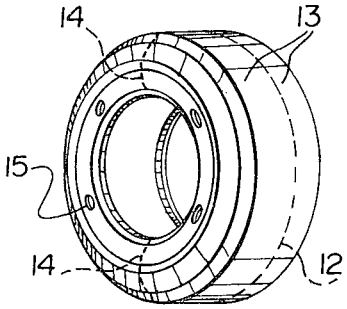
FIG. 7 is a perspective view of a vehicle tire, which may be quartered and inserted as end elements in alternate rows in the rectangular array, according to the invention.
Figure 8:
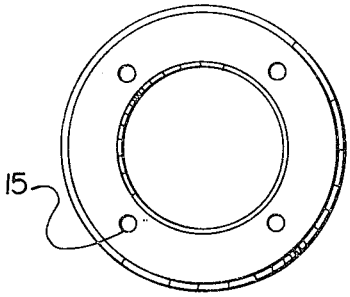
FIG. 8 is a side view of a vehicle tire, suitable for use in a blasting mat according to the invention.

A blasting mat, in general designated as 10, comprises a rectangular array of vehicle tire elements 11, as indicated in FIG. 1. It will be observed that most of the vehicle tire elements 11 are halved along imaginary line 12 as illustrated in FIG. 6. In alternating rows, pairs of tire sections 13 are positioned at the ends of the rows, as illustrated in FIGS. 2 and 4. Tire sections 13 have been halved along imaginary line 12 and quartered along imaginary line 14 as may be observed in FIG. 7. Boreholes 15 are located in the side walls of each of vehicle tire sections as best may be seen in FIG. 8.

Figure 3:
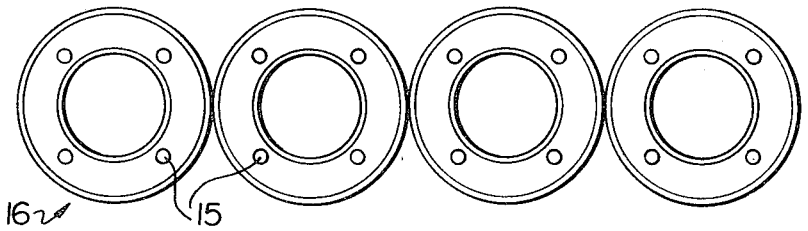
FIG. 3 is an elevation view of a section of the blasting mat taken along the line 3—3 in FIG. 1.
Figure 5:
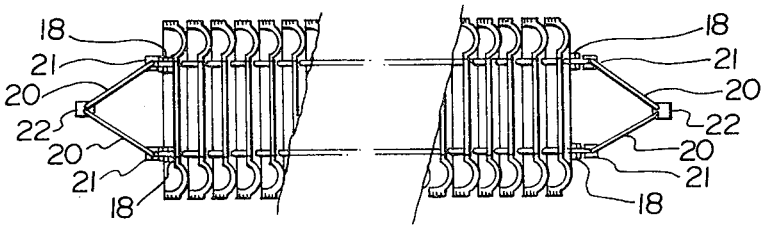
FIG. 5 is a side elevation view of a section of the blasting mat taken along line 5—5 in FIG. 1.

The vehicle tire elements 11 are aligned in rows 16 which are positioned adjacent to each other in offset fashion forming a brickwork pattern as seen in FIG. 1. Cross-sections of representative rows 16 are illustrated in FIGS. 3 and 4. The rows of vehicle tire elements are held in place by means of retaining lines 17 communicating internally through boreholes 15 and in clamping engagement externally through reinforcing bars 18. The reinforcing bars 18 are provided with boreholes 19, as illustrated in FIG. 2, through which communicate retaining lines 17. The ends of retaining lines 17 are held in clamping engagement each to the other and to pulling lines 20 by means of clamps 21. This arrangement is readily apparent in FIGS. 1 and 5. It will be observed, from an inspection of FIG. 5, that an upper pulling line 20 which is clamped to the ends of retaining lines 17 that communicate through the uppermost boreholes 15, and a lower pulling line 20 which is clamped to the ends of retaining lines 17 that communicate through the lowermost boreholes 15, are clamped together by means of clamp 22, to facilitate attachment to an external pulling or lifting apparatus.

Variations and modifications of the structure described herein will occur to those skilled in the art. The scope of the invention is as defined in the appended claims, and should not be limited to the specific structure demonstrated and described.

I claim:

1. A blasting mat comprising an interconnected array of circumferentially intact vehicle tire elements, comprising alternating contacting rows of tread-to-tread contacting tire elements of similar peripheral dimensions, the tire elements in any given row offset by about one-half a tire diameter from the adjacent tire elements in each adjacent row thus forming a brickwork pattern, and retaining means contacting the tire elements and retaining the tire elements in the said array.

2. A blasting mat as defined in claim 1, wherein the tire elements are similarly perforated generally parallel to their axes of rotation and said retaining means comprises lines passing through the perforations.

3. A blasting mat as defined in claim 2, additionally comprising, in every second row, a pair of end half-sections of tire elements of similar dimensions to the circumferentially intact tire elements which are positioned at the extremities of the said last mentioned rows, and wherein all of the rows are of substantially the same overall length, whereby the array is of generally rectangular form.

4. A blasting mat comprising an array of resilient elements, said array having two broad surfaces, two sides and two ends, wherein the majority of said elements are parts of vehicle tires which are intact circumferentially, and are positioned so that the axis of rotation of each tire is parallel to the broad surfaces of the array and to the sides of the array; and a retaining means for holding said resilient elements in fixed relationship and close proximity, one to the other.

5. A blasting mat as defined in claim 4, wherein each said element is a vehicle tire which has been halved in the plane normal to the axis of rotation of said vehicle tire.

6. A blasting mat as defined in claim 5 wherein said array comprises adjacent rows of vehicle tire parts, each row being made up of vehicle tire parts which are aligned so that the axis of rotation of each of the tire parts is perpendicular to the row, said rows being positioned adjacent to one another in staggered fashion, alternate rows having vehicle tire parts located at the ends of said rows which have been halved in the radial direction.

7. A blasting mat as defined in claim 6, wherein the tires have a uniform orientation.

8. A blasting mat as claimed in claim 7, wherein the retaining means are lines internally engaging the side walls of each vehicle tire part in the rectangular array.

9. A blasting mat as defined in claim 8, wherein the ends of the rectangular array are reinforced by rigid bars, said bars communicating internally with said cables.

10. A blasting mat as defined in claim 9, wherein at least two parallel series of internal cables are provided.

11. A blasting mat as defined in claim 10 wherein the pulling means comprises cables clampedly attached to external portions of said internal cables.

* * * * *